United States Patent [19]

Mahnke et al.

[11] Patent Number: 4,744,559

[45] Date of Patent: May 17, 1988

[54] MULTI-STATION EXERCISE APPARATUS

[75] Inventors: Parker E. Mahnke, Studio City; Ron Sheltra, Alhambra, both of Calif.

[73] Assignee: Marcy Gymnasium Equipment Co., Ontario, Calif.

[21] Appl. No.: 889,766

[22] Filed: Jul. 28, 1986

[51] Int. Cl.[4] ..... A63B 21/06

[52] U.S. Cl. ..... 272/118

[58] Field of Search ..... 272/117, 118, 123, 130–143

[56] References Cited

U.S. PATENT DOCUMENTS

| | | | |
|---|---|---|---|
| 931,699 | 8/1909 | Medart | 272/118 |
| 2,977,120 | 3/1961 | Morris | 272/118 |
| 4,199,139 | 4/1980 | Mahnke et al. | 272/118 |
| 4,505,475 | 3/1985 | Olschansky et al. | 272/118 |
| 4,549,733 | 10/1985 | Salyer | 272/118 |
| 4,624,457 | 11/1986 | Silberman et al. | 272/118 |
| 4,634,127 | 1/1987 | Rockwell | 272/118 X |
| 4,648,594 | 3/1987 | Schleffendorf | 272/118 |
| 4,697,809 | 10/1987 | Rockwell | 272/118 |

FOREIGN PATENT DOCUMENTS

| | | | |
|---|---|---|---|
| 3326426 | 1/1985 | Fed. Rep. of Germany | 272/118 |

*Primary Examiner*—Richard J. Apley
*Assistant Examiner*—Robert W. Bahr

[57] ABSTRACT

A free-standing multi-station progressive resistance exercise apparatus which is small, light weight, highly versatile and easy to use. The apparatus includes a main frame comprising a central guide column, a carriage movable upwardly and downwardly along the central guide column, a stack of weights disposed below the carriage, a selector bar extending between the weights and the carriage for interconnecting a selected number of weights with the carriage, a body engaging handlebar connected to the carriage for vertical movement of the carriage relative to the guide column; a second frame including back to back guide tracks for guiding the vertical travel of first and second sheaves and first and second cable systems operably connected to a plurality of remote body engaging members for use in performing a wide variety of arm and leg exercises, the cable systems interconnecting the body engaging members with the weights via the sheaves and the carriage.

16 Claims, 5 Drawing Sheets

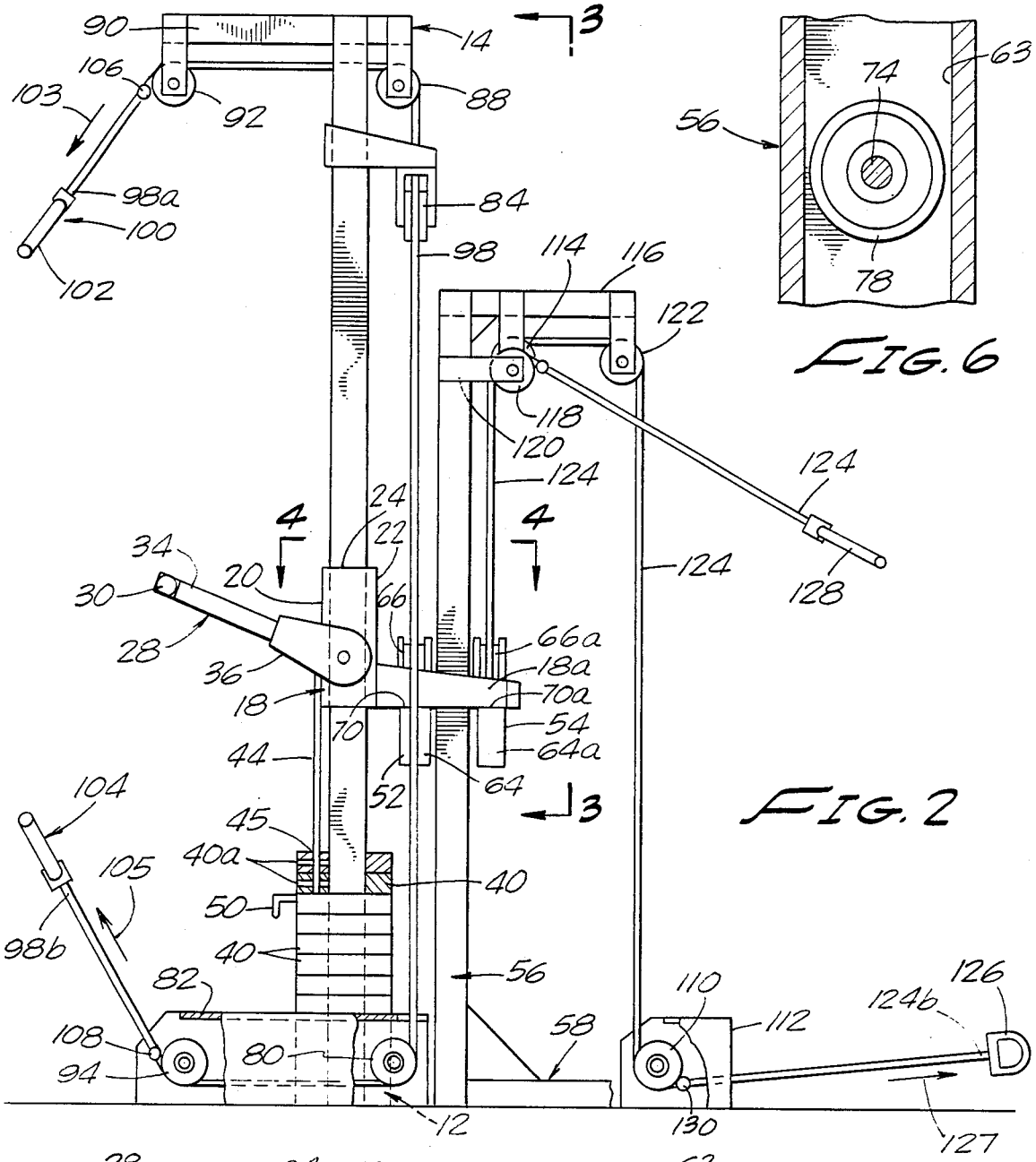
FIG. 2
FIG. 6
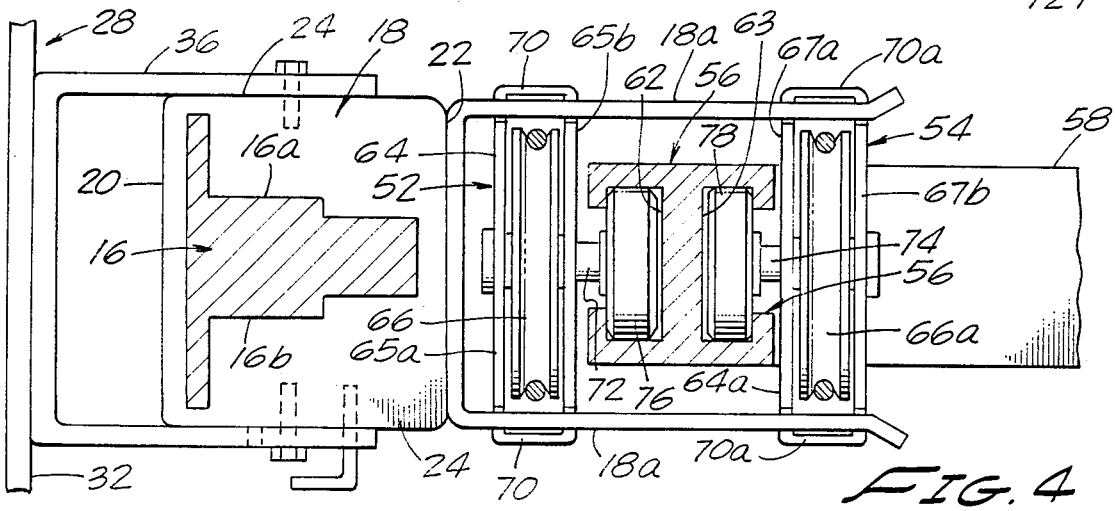
FIG. 4

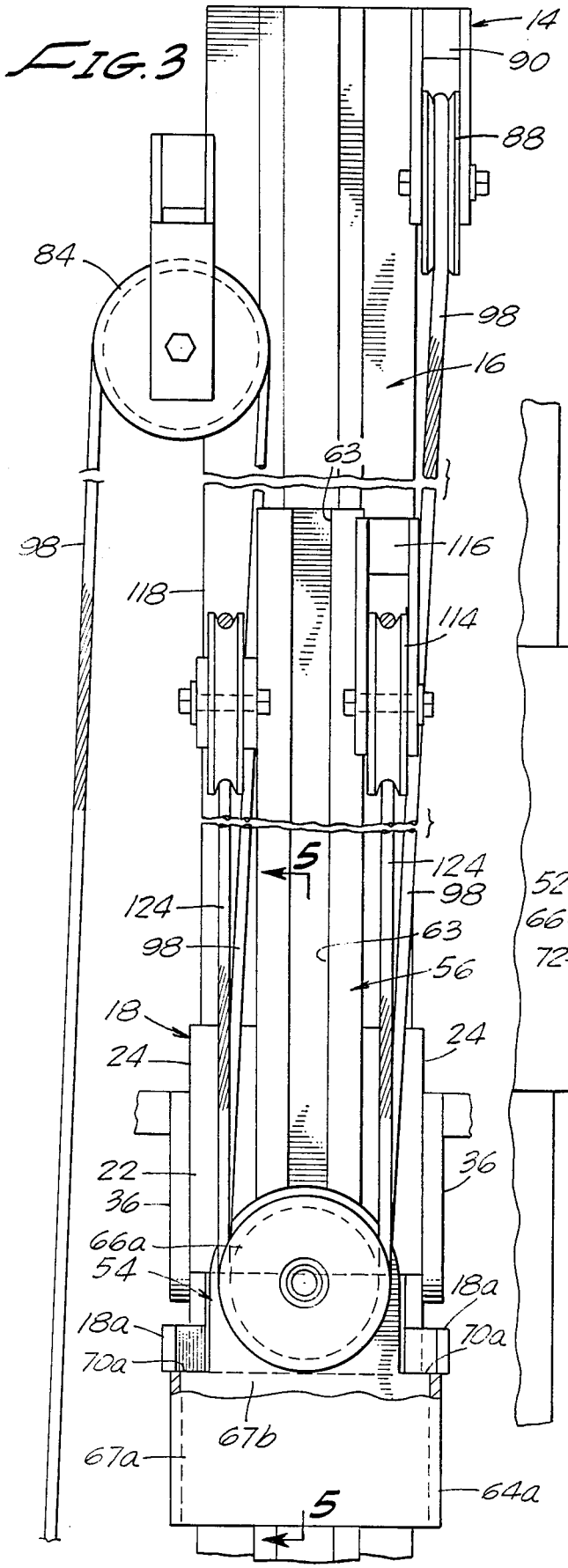
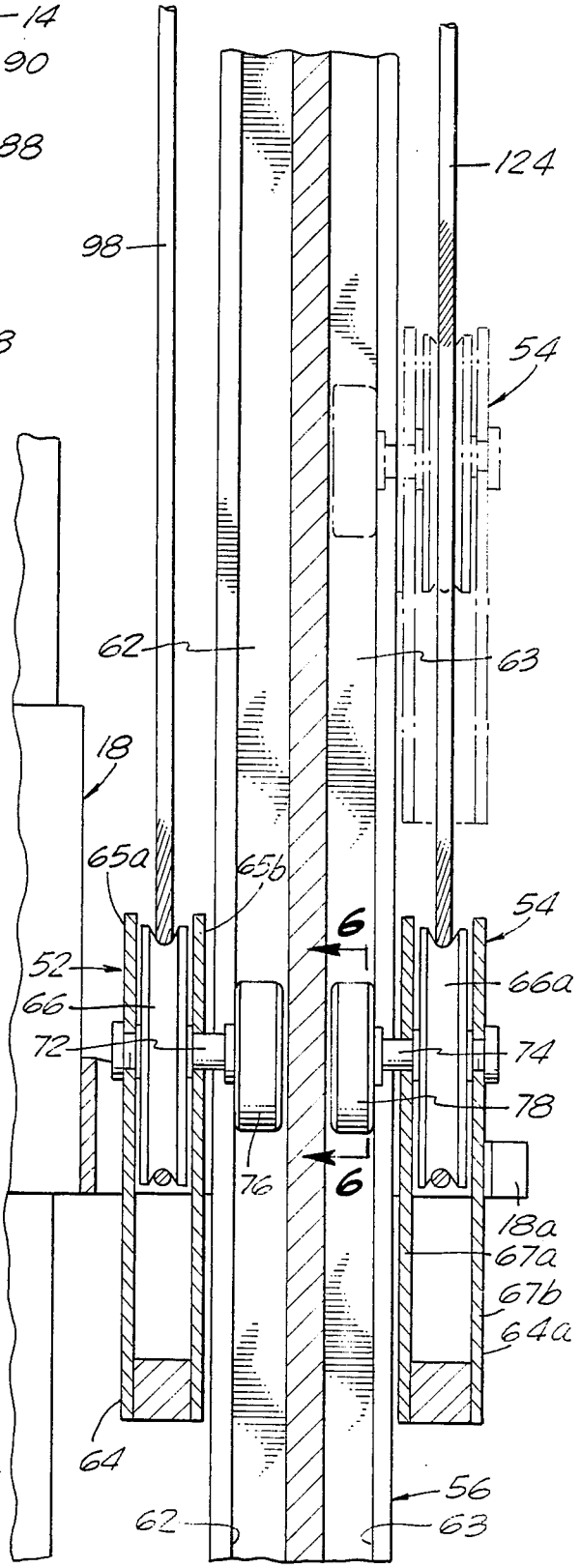
FIG. 5

14
88
84
98
86
16
90
92
106
98a
100
103
102
100
22
24
18
36
20
70
30
34
28
44
40
50
40
80
94
104
98b
105
108
82
12
56
58
112
110
124b
126
124
124a
128
122
116
114
118
120
52
9
9
18a
54
70
64a 14
88
84
98
86
16
90
92
106
98a
100
22
24
18
36
20
44
70a
40
50
52
64
40
80
82
94
104
98b
34
30
28
12
56
58
110
112
124b
126
124
124a
128
122
116
114
118
18a
54
70
64a

MULTI-STATION EXERCISE APPARATUS

BACKGROUND OF THE INVENTION

1. Field of the Invention

The present invention relates generally to a body exercising apparatus and more particularly to a free standing, multi-station exercise machine for accomplishing a number of progressive resistance type exercises using the single resistance means of the machine.

2. Discussion of the Prior Art

The therapeutic value of progressive resistance exercises has long been recognized. Exercising muscles against progressively increasing resistance not only results in added strength and endurance in the muscles, but also in the improvement of neuromuscular coordination and in a more efficient functioning of the cardiovascular and respiratory systems.

Traditionally apparatus such as dumbbells and barbells have been used for progressive exercises. The use of such apparatus, however, can be extremely dangerous when undertaken without proper training and supervision. When a large amount of weight is being lifted, barbells are particularly dangerous and present difficult balancing problems. If they are dropped, serious injury can result to the trainee or to those about him.

In the past, various types of progressive weight training machines have been suggested to overcome the drawbacks of barbells and dumbbells. Among the most successful of these prior are devices are those described in U.S. Pat. No. 3,971,555, U.S. Pat. No. Re. 28,066 and in U.S. Pat. No. 4,317,566.

Prior art apparatus embodying cable systems, while avoiding the drawbacks of free weights, have often been of very complex design. Most such apparatus rely on only one cable system to operably interconnect the resistance means and the lifting elements and, therefore, require very complicated connect and disconnect mechanisms to enable performance of multiple exercises. The highly novel design of the cable systems of the present invention avoids the drawbacks of the prior art units embodying cable systems and permits the performance of multiple exercises at remotely located exercise stations without the need for complex interconnection mechanisms.

SUMMARY OF THE INVENTION

It is an object of the present invention to provide an improved free-standing multi-station progressive resistance exercise apparatus which is small, light weight, highly versatile and easy to use. More particularly, an object of the invention is to provide an exercising machine which includes a single resistance means, preferably in the form of a stack of discrete weights, which provides the progressive resistance to the performance of several different kinds of exercises performed at several remotely located exercising stations.

Another object of the invention is to provide an apparatus of the aforementioned character which includes a main frame comprising a central guide column, a carriage movable upwardly and downwardly along the central guide column, a stack of weights disposed below the carriage, a selector bar extending between the weights and the carriage for interconnecting a selected number of weights with the carriage, a body engaging means, such as a handlebar, including gripping portions connected to the carriage for vertical movement of the carriage relative to the guide column; a second frame including guide means for guiding the vertical travel of first and second sheaves and first and second cable systems operably connected to a plurality of remote body engaging means for use in performing various arm and leg exercises, the cable systems interconnecting the body engaging means with the weights via the sheaves and the carriage.

Still another object of the invention is to provide a machine of the type described in the preceding paragraphs which embodies a unique mechanism for selectively interconnecting the reciprocative sheaves with the carriage and in turn with the weights of the weight stack.

A further object of the invention is to provide a machine of the class described in which the second frame includes a vertical guide column of novel, compact design having back to back tracks which guide the vertical travel of the sheaves.

Still another object is to provide such a machine which is highly safe and reliable, embodies a minimum number of component parts, is easily adjustable without the use of special tools and is smoother, safer and more positive in operation than similar prior art machines.

The superior engineering design and compactness of the machine of the present invention permits it to be inexpensively manufactured, easily set up and operated in numerous locations, and to be safely used even by unskilled persons with a minimum of training.

BRIEF DESCRIPTION OF THE DRAWINGS

FIG. 2 is a side elevational view of the apparatus.

FIG. 3 is an enlarged fragmentary view taken along lines 3—3 of FIG. 2

FIG. 4 is an enlarged cross-sectional view taken along lines 4—4 of FIG. 2.

FIG. 5 is a cross-sectional view taken along lines 5—5 of FIG. 3.

FIG. 6 is a cross-sectional view taken along lines 6—6 of FIG. 5.

DESCRIPTION OF THE INVENTION

Figure 1:
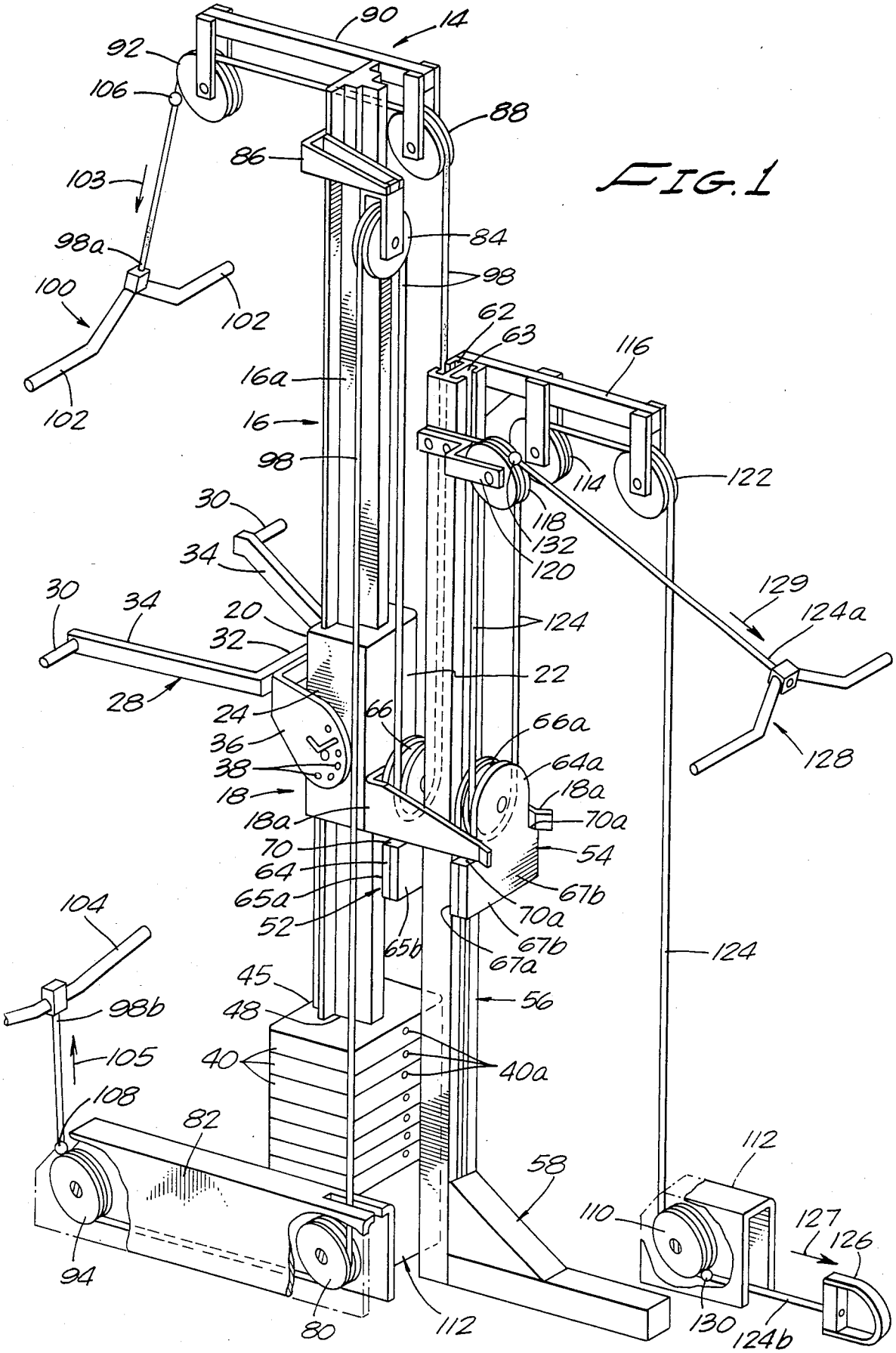
FIG. 1 is a generally perspective view of the apparatus of the invention.

Referring to the drawings, and particularly to FIGS. 1 through 4, the exercising apparatus of the present invention comprises a first frame means shown here as an upstanding main frame which includes a base 12, a top portion 14 and a generally vertically extending central guide column 16 disposed intermediate base 12 and top 14. As best seen by referring to FIG. 4, the central guide column 16 has a pair of transversely spaced guide surfaces 16*a* and 16*b*. A carriage 18 is adapted for vertical reciprocal movement upwardly and downwardly along central guide column 16 between a first lower position and a second higher, or upraised, position.

Referring to FIGS. 1 and 4, carriage 18 is provided with front, back and side portions 20, 22 and 24 respectively. Extending outwardly, or forwardly, relative to the front face 20 of the carriage 18 is first body engaging means for slidably moving the carriage 18 upwardly relative to central column 16. In this embodiment of the invention the first body engaging means comprises a handlebar-like member 28 which includes spaced apart hand engaging means, or hangrips, 30 adapted for engagement by the trainee, or user, of the apparatus. As illustrated in FIG. 1, handlebar 28 is generally U-shaped in configuration, having a bight portion 32 and angularly outwardly extending portions 34. Extending rearwardly from, and connected to bight portion 32 are transversely spaced apart, generally planar pivot plates or members 36. The spacing of members 36 is such that they will be closely received within the side panels 24 of the carriage 18 (FIG. 4). In a manner presently to be described, the first body engaging means is pivotally connected to carriage 18 and can be locked in a plurality of intermediate positions between a first lowered position and a second elevated position. For this purpose, members 36 are provided with a plurality of spaced apart apertures 38 which lie along an arc of a circle (FIG. 1).

Carried proximate base 12 and disposed below carriage 18 is resistance means for resisting upward movement of the carriage. This resistance means could take various forms such as springs, elastic bands, electromagnetic means or the like, but is shown here as a stack of discrete weights 40. To selectively interconnect carriage 18 with one or more of the weights 40 so as to bias carriage 18 against upward movement, there is provided a generally vertically extending connector column 44 (FIG. 2). This connector column, or selector bar, is pivotally connected proximate the base of carriage 18 and, in the manner shown in FIG. 2, depends downwardly through an aperture 45 formed in each of the weights 40.

As indicated in FIGS. 1 and 2, each of the weights 40 is also provided with an enlarged aperture portion 48 which is configured to closely receive the guide portions of central guide column 16. In FIG. 2, wherein only two of the weights 40 are shown as broken away, a portion of the selector bar 44 can be seen extending into the apertures 45 formed in the weights. Each weight is also horizontally drilled (FIG. 1) to form a passageway 40*a* adapted to receive a selector pin 50 (FIG. 2). The selector bar 40 is also provided with a plurality of vertically spaced apertures which are adapted to indexably align with the passageways 40*a* formed in weights 40. The selector pin 50 is of such a length that it will extend through the aperture in the connector column and a substantial distance into the horizontal bores formed in the weights 40. When the selector pin 50 is thus in place, the weights above the selector pin will be operably interconnected with the carriage 18 and will move with it as the carriage is moved upwardly along the central guide column 16 by forces exerted upwardly on the handlebar 28.

It is important to note that, as the carriage moves upwardly and downwardly, the central guide column not only constrains the path of the carriage, but also guides the vertical travel of the centrally apertured weights 40 which have been interconnected with the carriage. To assist in the smooth upward travel of the weights, guide bushings may, if desired, be provided in the central aperture portion 48 of each of the weights.

A very important aspect of the exercise apparatus of the present invention resides in the novel design of the second frame means of the apparatus and of the first and second vertically reciprocative sheave assemblies 52 and 54 carried thereby. In the present embodiment of the invention, the second frame means comprises a vertical column 56 which is interconnected with a perpendicularly, rearwardly extending base member 58. As best seen by referring to FIG. 4, column 56 is in the general configuration of an "I" beam defining first and second substantially vertically extending tracks 62 and 63, the purpose of which will presently be described.

In the present form of the invention, the first and second sheave assemblies 52 and 54 are of similar construction with sheave assembly 52 including a housing 64 within which is rotatably supported a sheave 66 and with sheave assembly 54 including a housing 64*a* within which is rotatably supported a sheave 66*a*. Housing 64 comprises identically configured front and rear plates 65*a* and 65*b* intermediate of which is rotatably supported sheave 66. Housing 64*a* also comprises identically configured front and rear plates 67*a* and 67*b* intermediate of which is rotatably supported sheave 66*a*. Sheave assemblies 52 and 54 are provided with transversely spaced horizontally extending side surfaces 70 and 70*a* respectively which, as best seen in FIG. 1, are engageable with rearwardly extending side members, or wings, 18*a* of carriage 18.

Turning once again to FIG. 4, an axle member 72 is carried by, and extends rearwardly through plate 65*a*, through sheave 66 and through plate 65*b* of first sheave assembly 52. Similarly, an axle 74 is carried by, and extends forwardly through plate 67*b*, through sheave 66*a* and through plate 67*a* of second sheave assembly 54. Mounted for rotation proximate the rearward extremity of axle 72 is a bearing means shown here as a roller 76. Mounted for rotation proximate the forward extremity of axle 74 is a second bearing means shown in the drawings as roller 78. As indicated in FIG. 4, sheave 66 is rotatably carried by axle 72 and sheave 66*a* is rotatably carried by axle 74. Also indicated in FIGS. 4 and 6, rollers 76 and 78 are closely received within tracks 62 and 63 of column 56 for closely guided vertical travel therewithin. With this construction, the first and second sheave assemblies 52 and 54 are vertically reciprocative between a first lowered position and a second raised position with their vertical movement closely guided by rollers 76 and 78 traveling within tracks 62 and 63.

Turning once again to FIG. 1, a first pulley system comprising a plurality of spaced apart pulleys is associated with sheave 66 and the previously identified first frame means which includes base 12, top 14 and guide column 16. Similarly, a second pulley system comprising a plurality of spaced apart pulleys is associated with sheave 66*a* and is carried by the previously identified second frame means which includes guide column 56 and base 58. Forming a part of the first pulley system is a first pulley 80 rotatably carried within a forwardly extending housing 82, which housing forms a part of the first frame means and is located proximate the base 12 thereof. A second pulley 84 is vertically spaced from pulley 80 and is rotatably carried by a rearwardly extending arm assembly 86 which is connected to column 16 and also forms a part of the first frame means. A third pulley 88 is transversely spaced from pulley 84 and is rotatably carried by top portion 14 which includes an upper, forwardly extending pulley carrying support 90. Pulley carrying support 90 also carries a forwardly disposed upper pulley 92. A forwardly disposed lower pulley 94 is similarly housed within, and rotatably carried, by base pulley housing 82.

Operably interconnecting the pulleys of the first pulley system is an endless connector means or member 98. Member 98, which may be in the form of an elongated steel cable, a length of nylon rope or other suitable connector, has first and second extremities **98*a* and 98*b* and is sequentially entrained around pulley 94, around first pulley 80, upwardly and around second pulley 84, downwardly around first sheave 66, upwardly around third pulley 88 and then forwardly around forward pulley 92**.

A second, elevated body engaging means for engagement by a trainee, hereshown as handle bar structure 100, having hand grips 102 proximate either extremity thereof, is connected to first cable, or member, 98 proximate extremity **98*a* thereof. A downward force exerted by the trainee on the body engaging means, or handle bar 100 will result in movement of extremity 98*a* of the connector 98 in a generally downwardly first direction indicated by the arrow 103 in FIG. 1**.

Connected proximate the second, or lower extremity **98*b* of connector 98 is a third body engaging means shown here in the form of a handle bar 104. An upward, lifting movement exerted on handle bar 104 by the trainee will cause extremity 98*b* of connector 98 to move upwardly in the direction of the arrow 105 in FIG. 1**.

A first, or upper stop means in the form of a generally spherical shaped stop member 106, is provided on connector 98 at a spaced apart location from extremity **98*a*. This stop member 106 is of a greater diameter than the cable groove of pulley 92 and is adapted to move into blocking engagement with pulley 92 in a manner to prevent movement of extremity 98*a* of first connector 98 in a second direction, that is a direction opposite the direction of the arrow 103. A second, or lower, stop means provided in the form of a second spherical member 108, is carried by connector 98 at a location spaced apart from extremity 98*b* of the connector. Spherical stop member 108 is also of a diameter greater than the cable groove of pulley 94 is adapted to engage pulley 94 in a manner to prevent movement of extremity 98*b* of the connector in a first direction, that is in a direction opposite to the direction of travel of the connector as indicated by arrow 105**.

Figure 8:
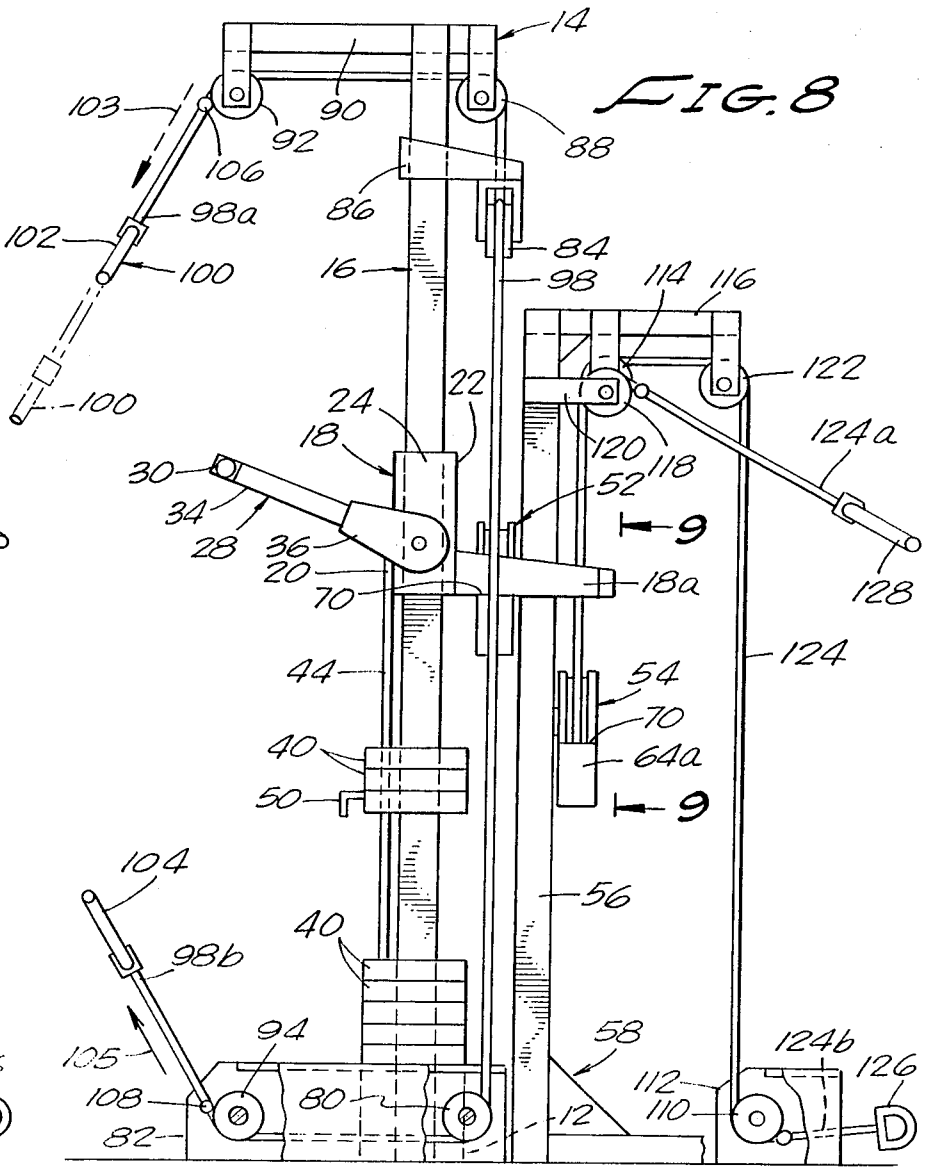
FIG. 8 is a side elevational view similar to FIG. 7 but illustrating the appearance of the components of the apparatus when the carriage and the weights connected thereto are elevated by means of upward movement of the forward sheave of the apparatus.

Turning to FIG. 8, with the construction of the apparatus thus described, a force exerted by the trainee on handle bar 100 in the direction of arrow 103 will result in extremity **98*a* of the connector 98 moving downwardly in a first direction indicated by the arrow 103 (see phantom lines of FIG. 8). Because the other extremity of the cable 98*b* is prevented by stop 108 from moving downwardly in this first direction opposite the direction indicated by the arrow 105, continued force exerted on handle bar 100 will cause upward movement of sheave assembly 52 and sheave 66 which upward movement will be guided by the guide means, or track 62, within which roller 76 rolls. When the sheave 66 reaches the position shown in FIG. 1, the transverse surfaces 70 of the sheave housing will move into engagement with the side or wing-like members 18*a* which extend rearwardly from carriage 18. Continued downward movement of handle bar 100 will result in continued upward movement of sheave assembly 52 resulting in upward movement of carriage 18 against the downward urging of the weights 40 which are interconnected with the carriage by means of connector column 44**.

If a lifting, or upward force is exerted by the trainee on handle bar 104 in the direction of the arrow 105, upward movement of sheave assembly 52 will also result due to the fact that movement of extremity **98*a* of connector 98 in a direction opposite to the direction of arrow of 103 will be prevented by stop member 106. Accordingly, continued movement of extremity 98*b* in the direction of arrow 105 will result in the upward movement of sheave assembly 52. Once again, when the sheave assembly reaches the position shown in FIG. 1, continued upward movement of handle bar 104 by the trainee will result in upward movement of the sheave assembly 52 and the carriage 18 which is now in engagement with transversely spaced surfaces 70** of the sheave assembly.

Figure 7:
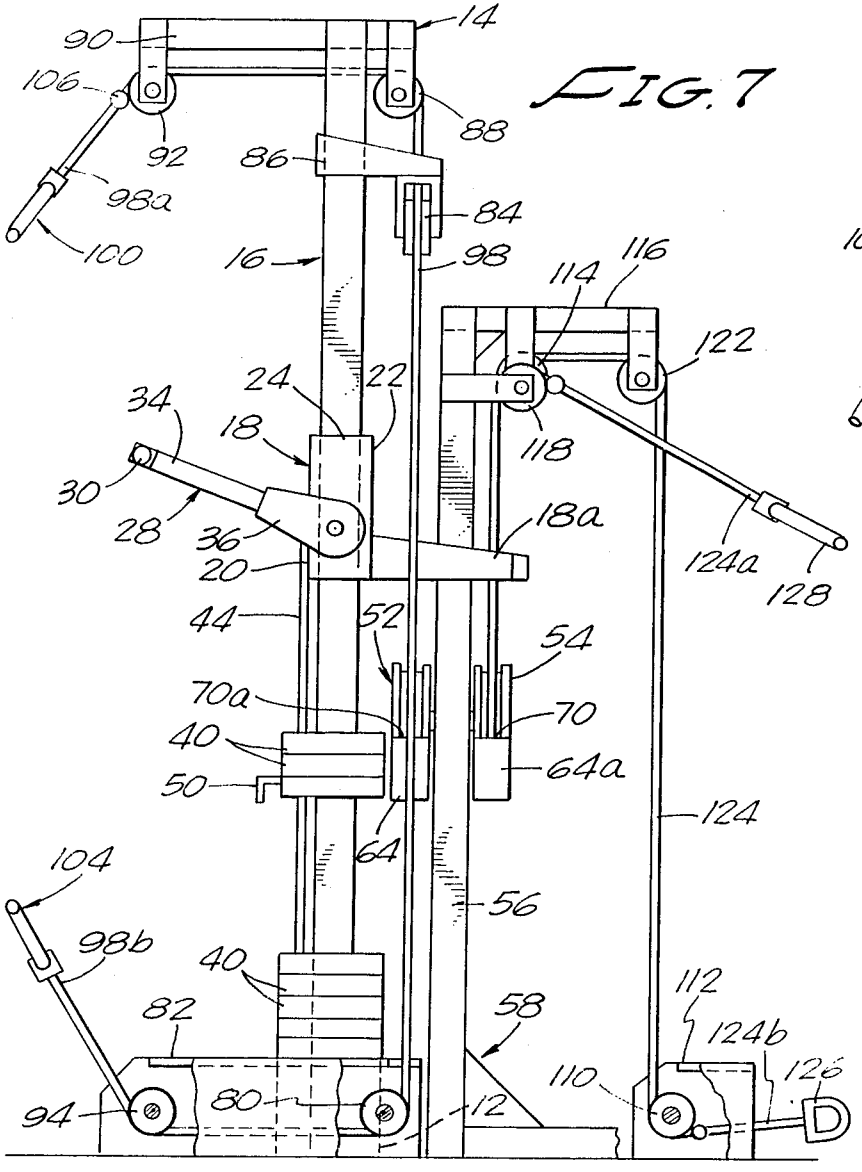
FIG. 7 is a side elevational view of the apparatus similar to FIG. 2 but illustrating reciprocal movement of the carriage of the apparatus independently from the reciprocating sheaves.

Referring to FIG. 7, it is apparent that with the novel construction of the apparatus as previously described, an upward movement by the trainee exerted on handle bar 28 will result in upward movement of the carriage against the urging of the weights connected with connector 44. However, in this instance, because the wing shaped side members **18*a* of the carriage move upwardly and away from sheave assemblies 52 and 54, these assemblies will remain at rest and in a non-interfering mode with the performance of exercises using body engaging means 28**.

Considering now the previously identified second pulley system which is carried by the second frame means and is associated with sheave member **66*a*, this second pulley system comprises a fourth pulley 110 rotatably carried within a rearwardly extending housing 112, which housing forms a part of the second frame means and is located proximate the base 58 thereof. A fifth pulley 114 is vertically and forwardly spaced from pulley 110 and is rotatably carried by a rearwardly extending arm assembly 116 which is connected to column 56 and also forms a part of the second frame means. A sixth pulley 118 is transversely spaced from pulley 84 and is rotatably carried by upper, rearwardly extending pulley carrying support 120. It is to be noted that pulley carrying support 116 also carries an upper pulley 122 which is located rearwardly of pulley 114**.

Operably interconnecting the pulleys of the second pulley system is an endless connector means or member 124. Member 124, which may be in the form of an elongated steel cable, a length of nylon rope or other suitable connector, has first and second extremities **124*a* and 124*b* and is sequentially entrained around fourth pulley 110, upwardly and around pulley 122, around fifth pulley 114, downwardly around second sheave 66*a*, and then upwardly around sixth pulley 118**.

A fourth body engaging means for engagement by a trainee, hereshown as a foot engaging stirrup structure 126, is connected to cable, or member, 124 proximate extremity **124*b* thereof. A rearwardly outward force exerted by the trainee on the body engaging means, or stirrup 126 will result in movement of extremity 124*b* of the connector 124 in a generally rearwardly first direction indicated by the arrow 127 in FIG. 1**.

Connected proximate the upper extremity 124*a* of connector 124 is a fifth body engaging means shown here in the form of a handle bar 128. A downwardly and rearward pulling movement exerted on handle bar 128 by the trainee will cause extremity 124*a* of connector 124 to move in the direction of the arrow 129 in FIG. 1.

A third stop means in the form of a generally spherical shaped stop member 130, is provided on connector 124 at a spaced apart location from extremity 124*b*. This stop member 130 is of a greater diameter than the cable groove of pulley 130 and is adapted to move into blocking engagement with pulley 130 in a direction opposite the direction of the arrow 127. An upper stop means, provided in the form of a spherical member 132, is carried by connector 124 at a location spaced apart from extremity 124*a* of the connector. Spherical stop member 132 is of a diameter greater than the cable groove of pulley 118 and is adapted to engage pulley 118 in a manner to prevent movement of extremity 124*a* of the connector in a direction opposite to the direction of travel of the connector as indicated by arrow 129.

Figure 10:
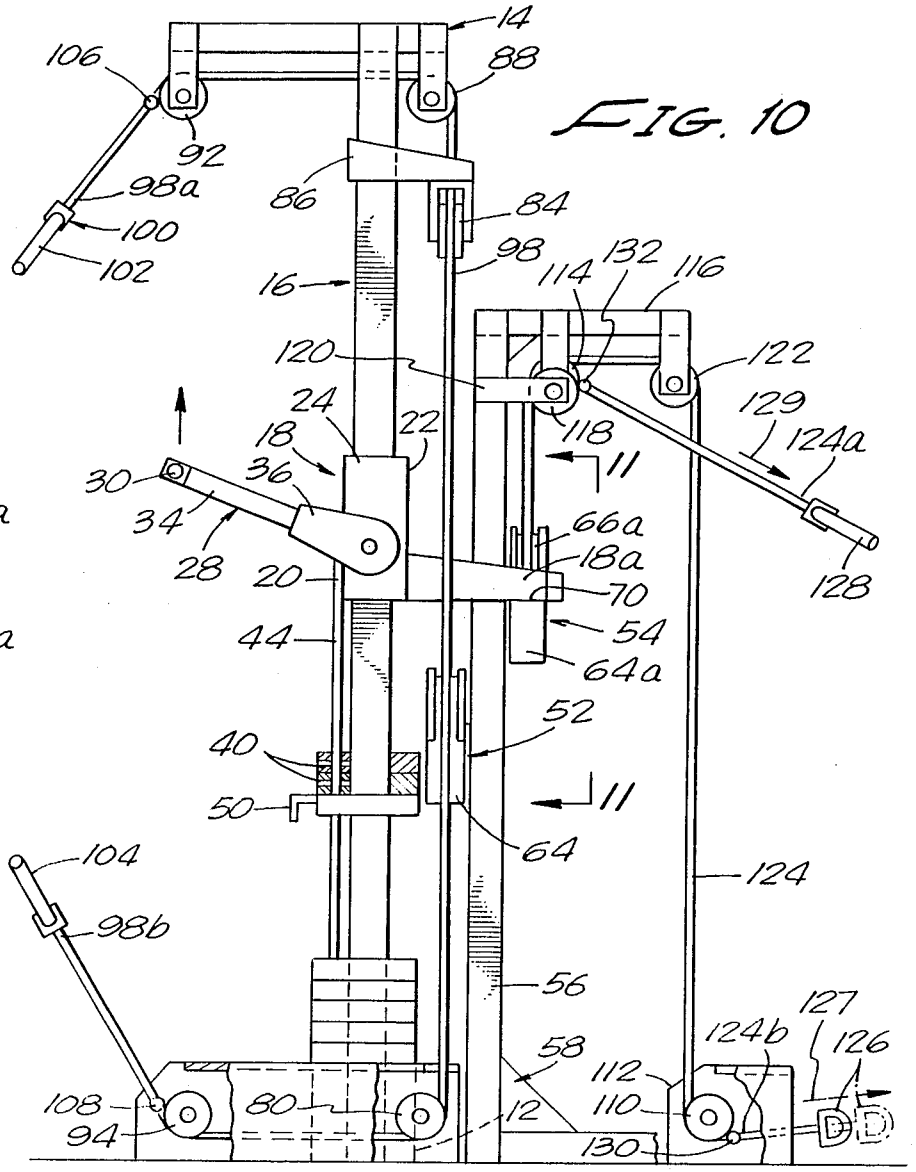
FIG. 10 is a view similar to FIG. 8 but illustrating the reciprocal movement of the carriage of the device as a result of reciprocal movement of the second, or rearward, sheave.
Figure 11:
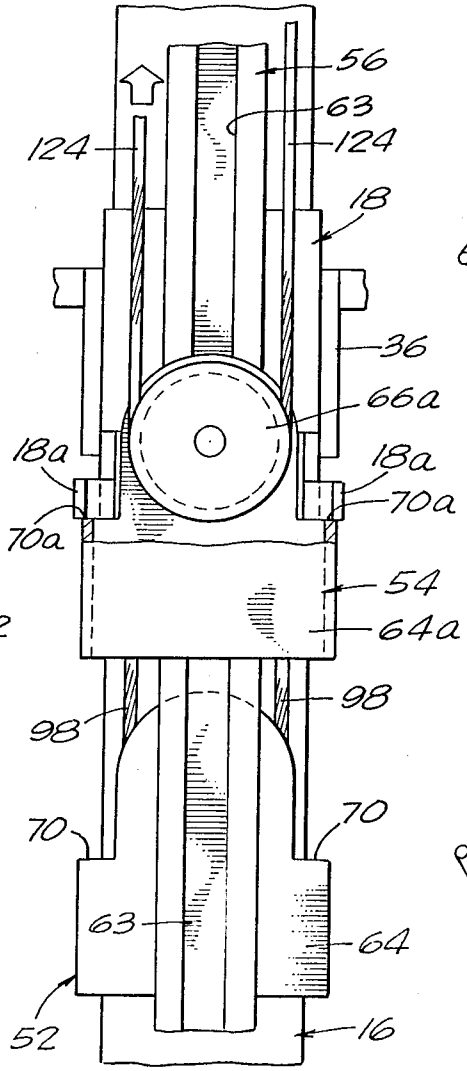
FIG. 11 is an enlarged fragmentary view taken along lines 11—11 of FIG. 10.
Figure 9:
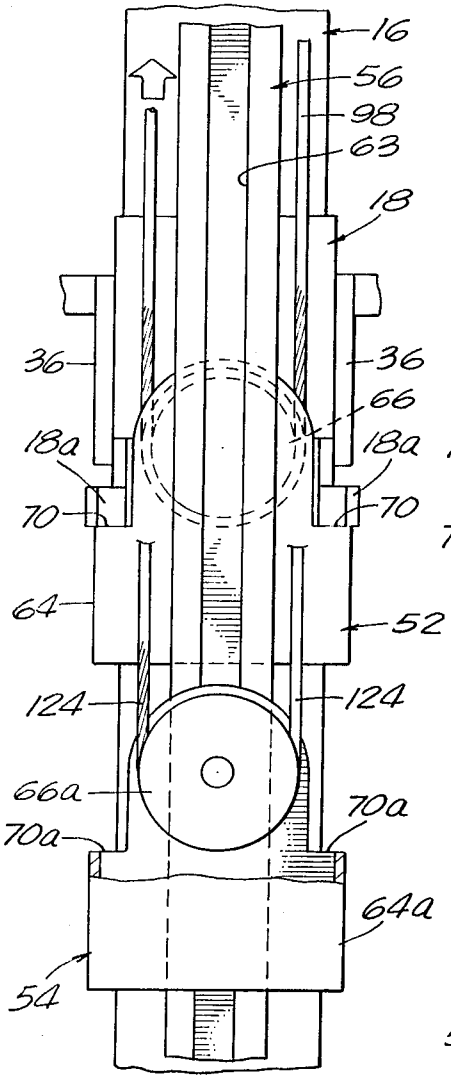
FIG. 9 is an enlarged fragmentary view taken along lines 9—9 of FIG. 8.

Turning now to FIG. 10, with the construction of the apparatus thus described, a force exerted by the trainee on stirrup 126 in the direction of arrow 127 will result in extremity 124*b* of the the connector 124 moving rearwardly in a direction indicated by the arrow 127 (see phantom lines of FIG. 10). Because the other extremity of the cable 124*a* is prevented by stop 132 from moving in this direction 127 opposite the direction indicated by the arrow 129, continued rearward force exerted on stirrup 126 will cause upward movement of sheave assembly 54 and sheave 66*a*, which upward movement will be guided by the guide means, or track 63, within which roller 78 rolls. When the sheave 66*a* reaches the position shown in FIG. 1, the transverse surfaces 70*a* of the sheave housing will move into engagement with the side or wing-like members 18*a* which extend rearwardly from carriage 18. Continued rearward movement of stirrup 126 will result in continued upward movement of sheave assembly 54 resulting in upward movement of carriage 18 against the downward urging of the weights 40 which are interconnected with the carriage by means of connector column 44.

If a downward and rearward force is exerted by the trainee on handle bar 128 in the direction of the arrow 129, upward movement of sheave assembly 54 will also result due to the fact that movement of extremity 124*b* of connector 124 in a direction opposite to the direction of arrow of 127 will be prevented by stop member 130. Accordingly, continued movement of extremity 124*a* in the direction of arrow 129 will result in the upward movement of sheave assembly 54. Once again, when the sheave assembly reaches the position shown in FIG. 1, continued rearward movement of handle bar 128 by the trainee will result in upward movement of the sheave assembly 54 and the carriage 18 which is now in engagement with transversely spaced surfaces 70*a* of the sheave assembly.

From the foregoing, it is apparent that a wide variety of exercises designed to exercise every part of the body can be performed using the five body engaging means of the apparatus. However, due to the unique design of the apparatus, only one weight stack need be included to provide selectively progressive resistance to the exercises performed using the five body engaging means. This highly simplified design substantially reduces the weight, size and complexity of the apparatus and provides versatility heretofore impossible with multipurpose prior art exercising apparatus.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

We claim:

1. An exercise apparatus, comprising:

(a) a reciprocating carriage;

(b) a first frame means, including carriage guide means for guiding reciprocative travel of said carriage;

(c) resistance means operably associated with said carriage for yieldably resisting reciprocative travel thereof in one direction;

(d) first and second reciprocative sheaves operably associated with said carriage said carriage being reciprocatively movable in response to movement of said first or second sheaves;

(e) a second frame means, disposed in close proximity with said first frame means and including sheave guide means for guiding reciprocative travel of said first and second sheaves; and (f) body engaging means carried by said reciprocating carriage for moving said carriage independently of said first and second sheaves.

2. An exercise apparatus as defined in claim 1 in which said resistance means comprises at least one weight and in which said apparatus further includes a substantially vertically disposed connecting column connected to said carriage and adapted to be selectively connected to at least one of said weights whereby said carriage is biased in a vertically downward direction.

3. An exercise apparatus, comprising:

(a) a reciprocating carriage;

(b) a first frame means, including carriage guide means for guiding reciprocative travel of said carriage;

(c) resistance means operably associated with said carriage for yieldably resisting reciprocative travel thereof in one direction;

(d) first and second reciprocative sheaves operably associated with said carriage, said carriage being reciprocatively movable in response to movement of said first or second sheaves;

(e) a second frame means, including sheave guide means for guiding reciprocative travel of said first and second sheaves;

(f) at least one first pulley carried by said first frame means at a spaced apart location from said first sheave;

(g) a first endless connector member having first and second extremities, said first connector being entrained around said first pulley and said first sheave;

(h) a first body engaging means connected to said first connector member proximate said first extremity thereof for urging movement of said first and second extremities thereof in a first direction;

(i) first stop means operably associated with said first connector member for preventing movement of said second extremity thereof in said first direction whereby movement of said first extremity thereof by said first body engaging means will result in movement of said first sheave in one direction;

(j) at least one second pulley carried by said second frame means at a spaced apart location from said second sheave;

(k) a second endless connector member having first and second extremities, said second connector being entrained around said second pulley and said second sheave;

(l) a second body engaging means connected to said second connector member proximate said first extremity thereof for urging movement of said first and second extremities thereof in a first direction; and (m) second stop means operably associated with said second connector member for preventing movement of said second extremity thereof in said first direction whereby movement of said first extremity thereof by said second body engaging means will result in movement of said second sheave in one direction.

4. An exercise apparatus as defined in claim 3 including at least two first pulleys carried by said first frame means and further including a third body engaging means connected to said first connector member proximate said second extremity thereof for urging movement of said first and second extremities thereof in a second direction.

5. An exercise apparatus as defined in claim 4 including third stop means operably associated with said first connector member for preventing movement of said first extremity thereof in said second direction.

6. An exercise apparatus as defined in claim 3 including at least two second pulleys carried by said second frame means and further including a fourth body engaging means connected to said second connector member proximate said second extremity thereof for urging movement of said first and second extremities thereof in a second direction.

7. An exercise apparatus as defined in claim 6 including fourth stop means operably associated with said second connector member for preventing movement of said first extremity thereof in said second direction.

8. An exercise apparatus as defined in claim 7 including fifth body engaging means carried by said reciprocative carriage for urging movement thereof in one direction against the resistance of said resistance means.

9. An exercise apparatus for use by a trainee in performing resistance exercises, comprising:

(a) a reciprocative carriage;

(b) a first frame means, including carriage guide means for guiding reciprocative travel of said carriage;

(c) resistance means operably associated with said carriage for yieldably resisting movement thereof in one direction;

(d) first and second reciprocative sheaves operably associated with said carriage, said carriage being reciprocatively movable in response to movement of said first and second sheaves;

(e) a second frame means disposed in close proximity with said first frame means including sheave guide means for guiding vertical travel of said first and second sheaves;

(f) first, second and third spaced apart pulleys rotatably carried by said first frame means;

(g) a first endless cable having first and second extremities, said cable being sequentially entrained around said first pulley, around said second pulley, around said first sheave and around said third pulley;

(h) first and second body engaging means for engagement by a trainee and connected to said first endless cable proximate said first and second extremities thereof respectively for movement of said first and second extremities in first and second directions respectively;

(i) first stop means associated with said endless cable for preventing movement of said first extremity thereof in a second direction;

(j) second stop means associated with said endless cable for preventing movement of said second extremity thereof in a first direction;

(k) fourth, fifth and sixth spaced apart pulleys rotatably carried by said second frame means;

(l) a second endless cable having first and second extremities, said cable being sequentially entrained around said fourth pulley, around said fifth pulley, around said second sheave and around said sixth pulley; and (m) third and fourth body engaging means for engagement by the trainee and connected to said second endless cable proximate said first and second extremities thereof respectively for movement of said first and second extremities in first and second directions respectively.

10. An exercise apparatus as defined in claim 9 in which said resistance means comprises at least one weight disposed substantially below said reciprocative carriage.

11. An exercise apparatus as defined in claim 9 in which said weight is apertured to closely receive said guide means whereby said guide means guides vertical travel of said weight.

12. An exercise apparatus as defined in claim 11 including a plurality of apertured weights and further including a substantially vertically disposed connecting column connected to said carriage and adapted to be selectively connected to at least one of said weights whereby said carriage is biased in a vertically downward direction, said connecting column being closely receivable in said aperture formed in said weights.

13. An exercise apparatus as defined in claim 12 in which said first and third body engaging means are disposed above said carriage and in which said second and fourth body engaging means are disposed below said carriage.

14. An exercise apparatus as defined in claim 13 including fifth body engaging means carried by said reciprocative carriage.

15. An exercise apparatus comprising:

(a) a vertically reciprocative carriage having a front face and a rear face and a pair of transversely spaced side members extending from said rear face;

(b) a first frame means, including carriage guide means for guiding vertical travel of said carriage;

(c) at least one weight disposed below said carriage;

(d) a substantially vertically disposed connecting column interconnecting said carriage with said weight;

(e) first and second sheave assemblies operably associated with said carriage, each of said sheave assemblies being vertically movable between a first lowered position and a second raised position and each comprising:

(i) a housing having transversely spaced surfaces engageable with said rearwardly extending side members of said carriage; and (ii) a sheave rotatably carried by said housing;

(f) a second frame means including means for guiding the vertical travel of said first and second sheave assemblies;

(g) at least one first pulley carried by said first frame means at a spaced apart location from said first sheave assembly;

(h) a first endless connector member having first and second extremities, said first connector being entrained around said pulley carried by said first frame and said sheave of said first sheave assembly;

(i) a first body engaging means connected to said first connector member proximate said first extremity thereof for urging movement of said first and second extremities thereof in a first direction;

(j) first stop means operably associated with said first connector member for preventing movement of said second extremity thereof in said first direction whereby movement of said first extremity thereof by said first body engaging means will result in said transversely spaced surfaces of said first sheave assembly moving into engagement with said rearwardly extending side members of said carriage to urge upward movement of said carriage;

(k) at least one first pulley carried by said second frame means at a spaced apart location from said second sheave assembly;

(l) a second endless connector member having first and second extremities, said second connector being entrained around said pulley carried by said second frame and said sheave of said second sheave assembly;

(m) a second body engaging means connected to said second connector member proximate said first extremity thereof for urging movement of said first and second extremities thereof in a first direction; and (n) second stop means operably associated with said first connector member for preventing movement of said second extremity thereof in said first direction whereby movement of said first extremity thereof by said second engaging means will result in said transversely spaced surfaces of said second sheave assembly moving into engagement with said rearwardly extending side members of said carriage to urge upward movement of said carriage.

16. An exercise apparatus as defined in claim 15 including body engaging means carried by said vertically reciprocative carriage for moving said carriage independently of said first and second sheaves.

* * * * *